US006632185B2

(12) United States Patent
Chen

(10) Patent No.: US 6,632,185 B2
(45) Date of Patent: Oct. 14, 2003

(54) EXTENDABLE ROTABLE MASSAGER

(76) Inventor: Chin-Chen Chen, No. 22, Miao-Hou Lane, Chung-Cheng Road, Mi-To Country, Kao-Hsiung Hsien (TW)

( * ) Notice: Subject to any disclaimer, the term of this patent is extended or adjusted under 35 U.S.C. 154(b) by 0 days.

(21) Appl. No.: 10/011,185

(22) Filed: Nov. 13, 2001

(65) Prior Publication Data

US 2003/0093016 A1 May 15, 2003

(51) Int. Cl.[7] ..... A61H 19/00
(52) U.S. Cl. ..... 601/101; 601/112; 600/38
(58) Field of Search ..... 601/72, 80, 97, 601/101–103, 112–114, 108, 109, 120, 123, 125, 126, 129, 130, 135, 137; 600/38

(56) References Cited

U.S. PATENT DOCUMENTS 4,162,675 A * 7/1979 Kawada ..... 601/112
4,827,914 A * 5/1989 Kamazawa ..... 601/101
5,460,597 A * 10/1995 Hopper ..... 601/101
5,470,303 A * 11/1995 Leonard et al. ..... 601/112
6,142,929 A * 11/2000 Padgett ..... 600/38
6,402,710 B1 * 6/2002 Hsu ..... 601/112

* cited by examiner

*Primary Examiner*—Danton D. DeMille
*Assistant Examiner*—Quang D. Thanh
(74) *Attorney, Agent, or Firm*—Ostrolenk, Faber, Gerb & Soffen, LLP

(57) ABSTRACT

A massager has a rotation shaft with arcuate grooves defined in a periphery of the rotation shaft and a guide received in the arcuate grooves so that when the rotation shaft rotates, the guide is able to control the rotation shaft to rotate and extend.

10 Claims, 8 Drawing Sheets

EXTENDABLE ROTABLE MASSAGER

FIELD OF THE INVENTION

The present invention relates to a massager, and more particularly to an extendable and rotatable massager. The massager has a rotation shaft with arcuate grooves defined in a periphery of the rotation shaft and a guide received in the arcuate grooves so that when the rotation shaft rotates, the guide is able to control the movement of the rotation shaft.

BACKGROUND OF THE INVENTION

Nowadays, a lot of different massagers are available on the market. People use the massagers for different purposes. With reference to FIGS. 1 and 2, a conventional massager for increasing the atmosphere between two sexes is shown. The massager has multiple blades rotatably and vibratably received in a silicon-made cover so that when the motor (not shown) in the massager is actuated, the blades are able to rotate and vibrate inside the cover. This kind of massager does have the effect to bring to the user the pleasure of self contempt. However, only rotation and vibration seem not enough for other requirement. That is, the massager is not able to extend so as to bring to the user a total different level of pleasure.

To overcome the shortcomings, the present invention intends to provide an improved massager to mitigate or obviate the aforementioned problems.

SUMMARY OF THE INVENTION

The primary objective of the invention is to provide an extendable and rotatable massager to satisfy needs of the user. The massager has a rotation shaft with arcuate grooves defined in the periphery of the rotation shaft and a guide received in the arcuate grooves such that when the rotation shaft rotates, the guide is able to drive the movement of the rotation shaft.

Other objects, advantages and novel features of the invention will become more apparent from the following detailed description when taken in conjunction with the accompanying drawings.

DETAILED DESCRIPTION OF THE INVENTION

Figure 1:
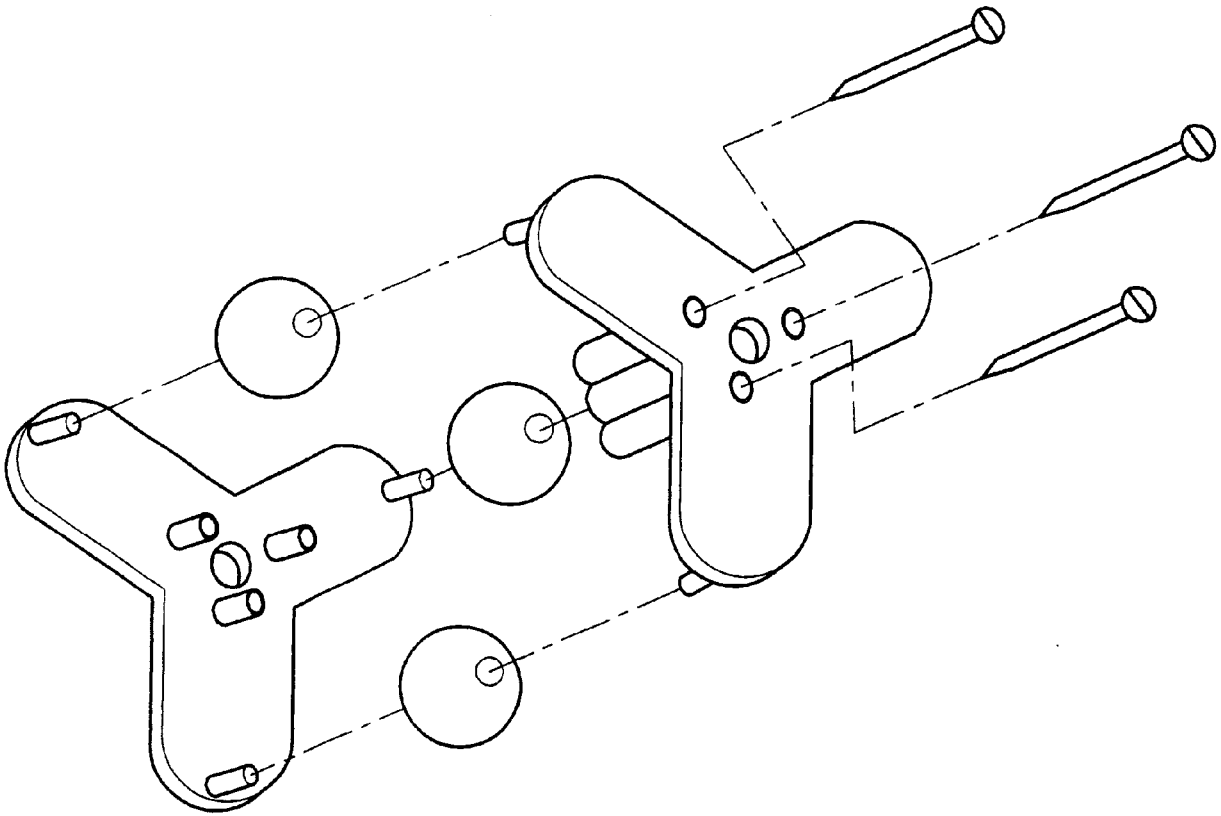
FIG. 1 PRIOR ART
FIG. 1 is an exploded perspective view of a conventional massager.
Figure 2:
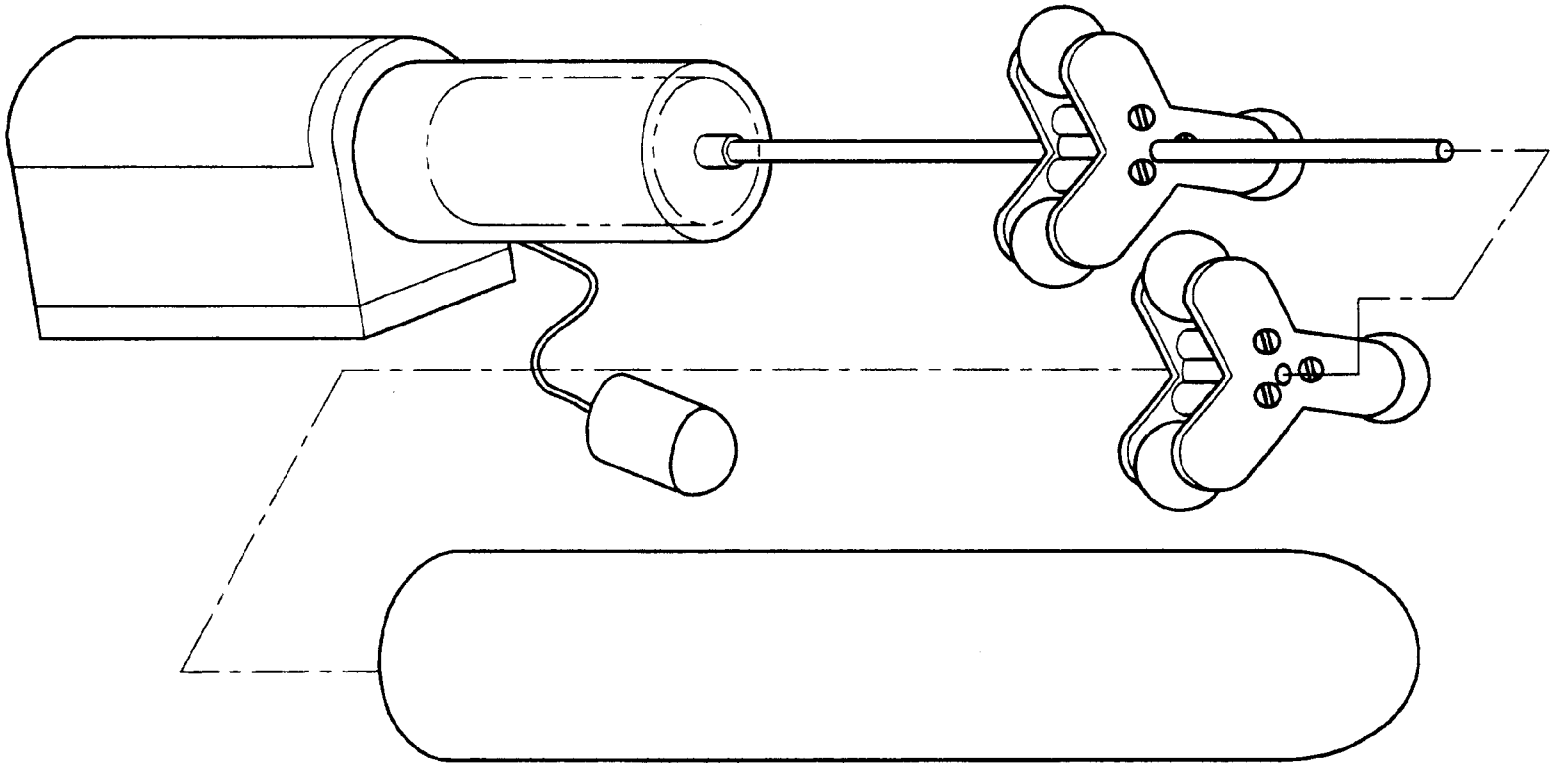
FIG. 2 PRIOR ART
FIG. 2 is an exploded perspective view of the conventional massager of FIG. 1, wherein a driving device for the blades of FIG. 1 is added to show the relationship between the driving device and the blades.
Figure 3:
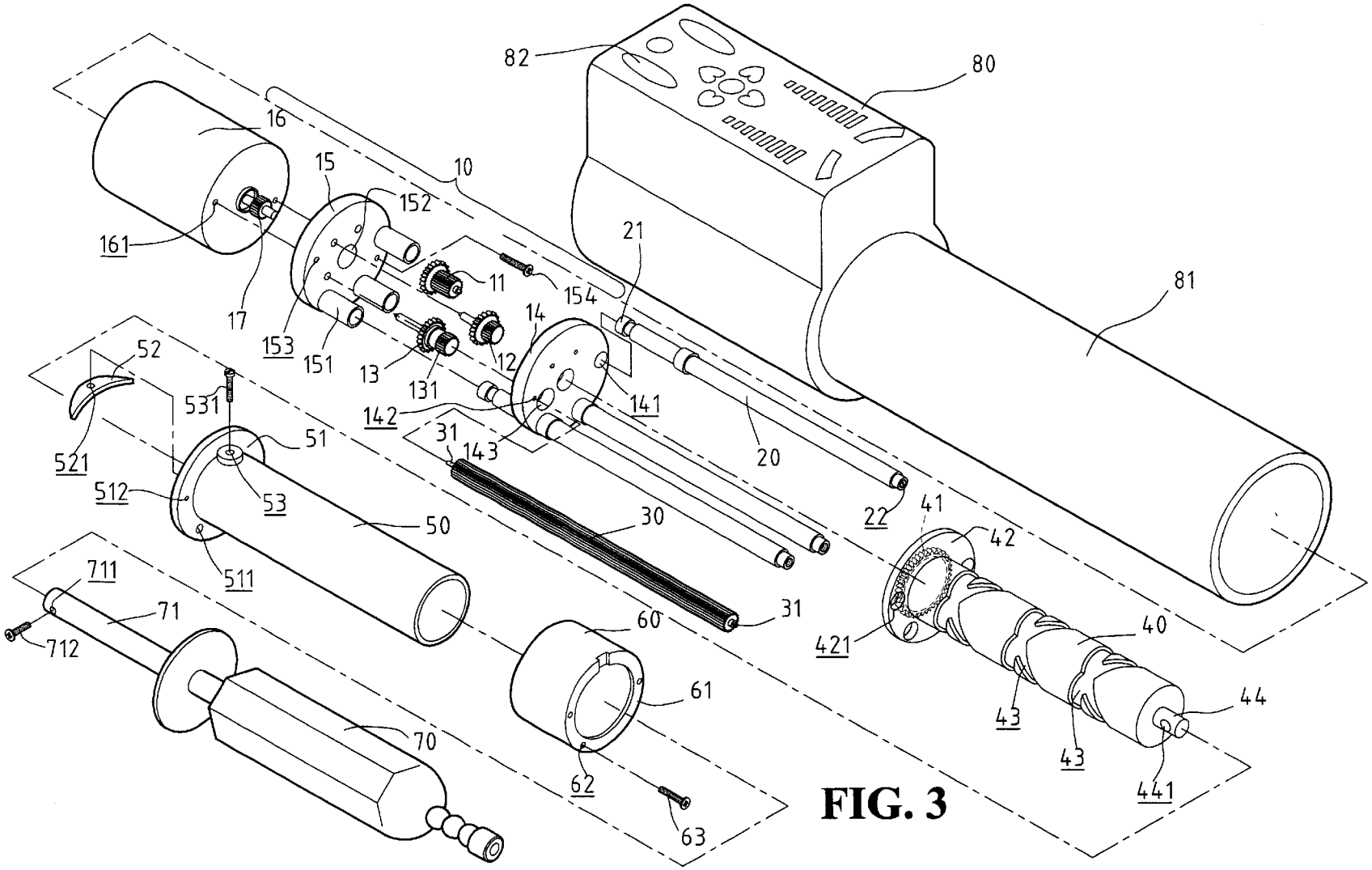
FIG. 3 is an exploded perspective view of the massager of the present invention.
Figure 4:
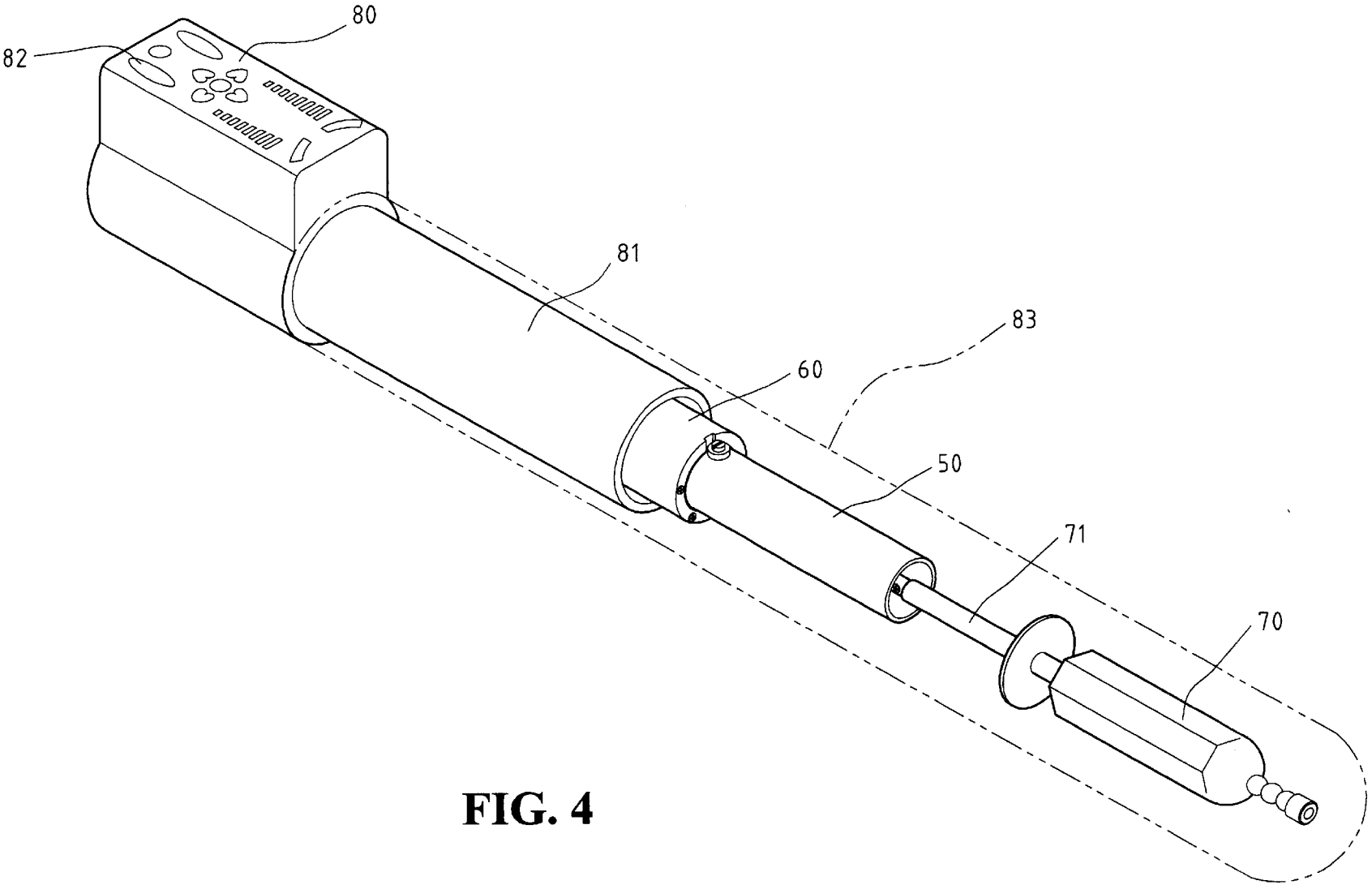
FIG. 4 is a perspective view showing the assembled massager of the present invention.

With reference to FIGS. 3 and 4, the massager in accordance with the present invention has a reduced gear assembly 10, sliding bars 20, a transmission rod 30, a rotation shaft 40, a sleeve 50, a positioning sleeve 60 and an extension tube 70.

The reduced gear assembly 10 has at least a first gear 11, a second gear 12 and a third gear 13 respectively and rotatably mounted between a first disk 14 and a second disk 15. The first disk 14 has assembly holes 141, a positioning hole 142 and a through hole 143 corresponding to an auxiliary gear 131 on the third gear 13. The second disk 15 has assembly tubes 151, a shaft hole 152 and screw holes 153, so that screws 154 are able to threadingly extend through the screw holes 153 to fix the second disk 15 to screw holes 161 of a motor 16 and the shaft 17 of the motor 16 is able to extend through the shaft hole 152 to mate with the first gear 11.

Each of the sliding bars 20 has a connection rod 21 provided on one end to extend through a corresponding one of the assembly holes 141 of the first disk 14 and securely engaged with a corresponding one of the assembly tubes 151 of the second disk 15 and an engaging hole 22 on the other end.

The transmission rod 30 has a positioning rod 31 on each end and one of the positioning rod 31 is securely mounted in the positioning hole 142 of the first disk 14 so that the transmission rod 30 is mated with the auxiliary gear 131 of the third gear 13.

The rotation shaft 40 has an annular gear 41 mounted on one end and a connection rod 44 on the other end, wherein the connection rod 44 has a connection hole 441. A disk 42 is rotatably and movably mounted on the rotation shaft 40 and has through holes 421 corresponding to the sliding bars 20 and the transmission rod 30 such that each of the sliding bars 20 and the transmission rod 30 are able to extend through the through holes 421 of the disk 42. The rotation shaft 40 has arcuate grooves 43 defined in a periphery of the rotation shaft 40 and maintained a predetermined angle to the longitudinal axis of the rotation shaft 40. The arcuate grooves 43 engage with each other in the periphery of the rotation shaft 40 so as to form a closed loop.

The sleeve 50 has a flange 51 on one end with screw holes 511 and a positioning hole 512 defined to receive the positioning rod 31 of the transmnission rod 30. The sleeve 50 further has a guide 52 securely yet rotatably received inside the sleeve 50. The guide 52 is arcuate with two opposite sharpened ends. The guide 52 has a shaft hole 521 so that screws 531 are able to threadingly extend through the through holes 53 on the periphery of the sleeve 50 and into the shaft hole 521 to secure the guide 52 in the sleeve 50.

The positioning sleeve 60 has a skirt 61 provided with screw holes 62, such that a screws 63 are able to threadingly extend through the screw holes 62 of the positioning sleeve 60, the screw holes 511 of the flange 51 of the sleeve 50 and into the engaging holes 22 of the sliding bars 20.

The extension tube 70 has a hollow extension 71 formed on one end and having a screw hole 711. The extension 71 connects to the connection rod 44 by screws 712 extending through the screw hole 711 and into the connection hole 441 of the connection rod 44.

When in assembly, the motor 16, the reduced gear assembly 10, the sliding bars 20, the transmission rod 30, the rotation shaft 40, the sleeve 50 and the positioning sleeve 60 are sequentially received in a tubular enclosure 81 of a control box 80 with the extension tube 70 exposed out of the tubular enclosure 81. Then a silicon-made cover 83 is mounted outside the assembled aforementioned elements to complete the assembly.

It is noted that after the assembly, the guide 52 is received in the arcuate groove 43 and the transmission rod 30 is mated with the auxiliary gear 131 of the third gear 13 as well as the annular gear 41.

Figure 5:
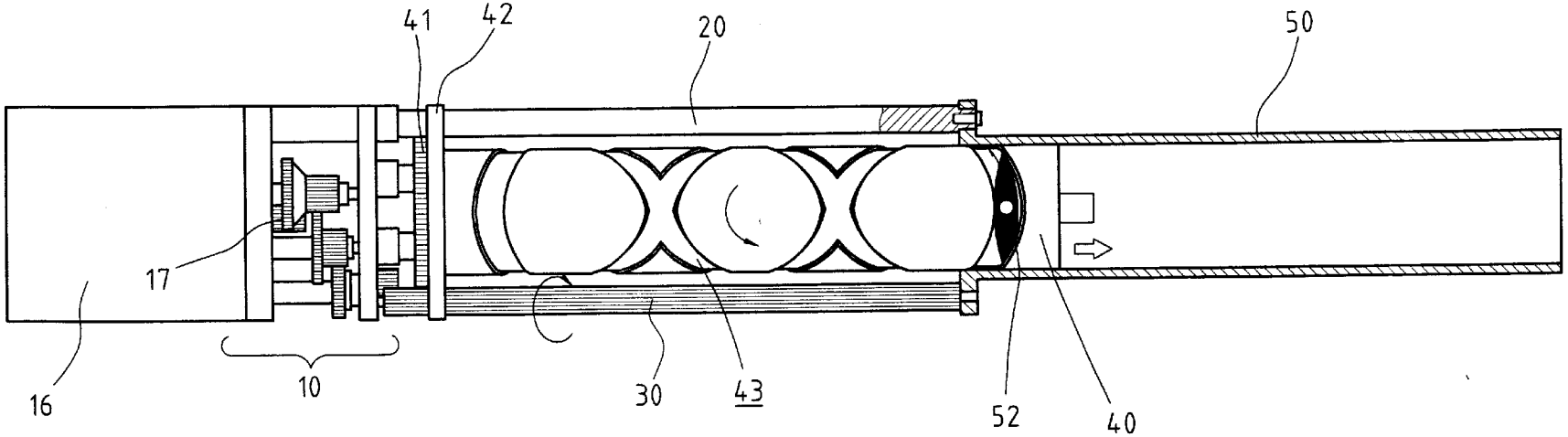
FIGS. 5, 6 and 7 are operational views of the movement of the rotation shaft.
Figure 6:
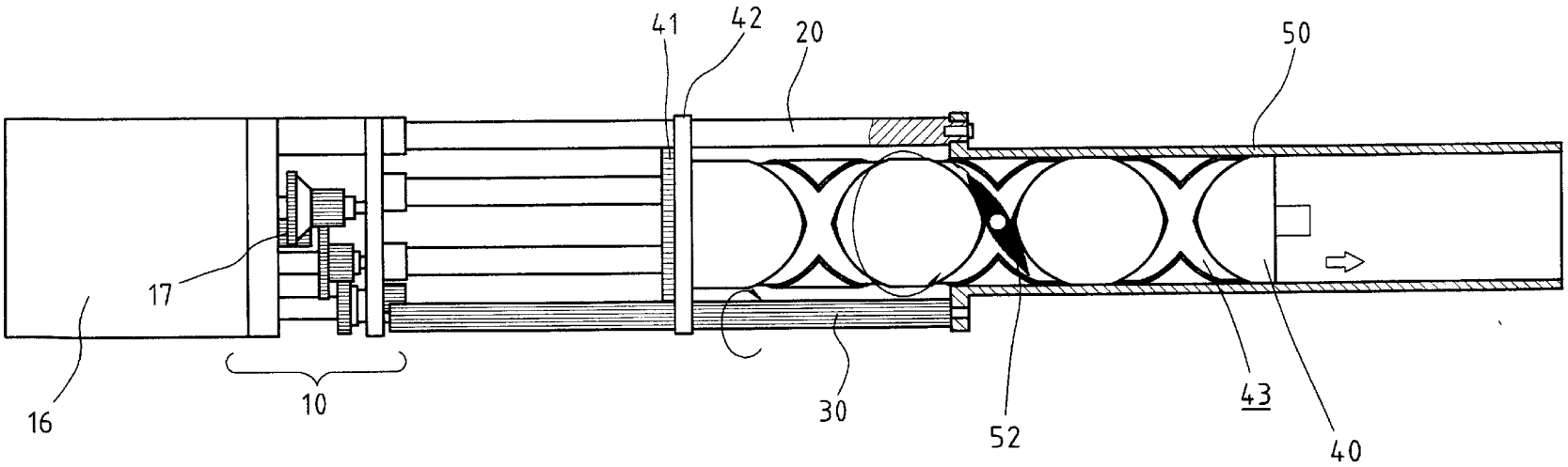
Figure 7:
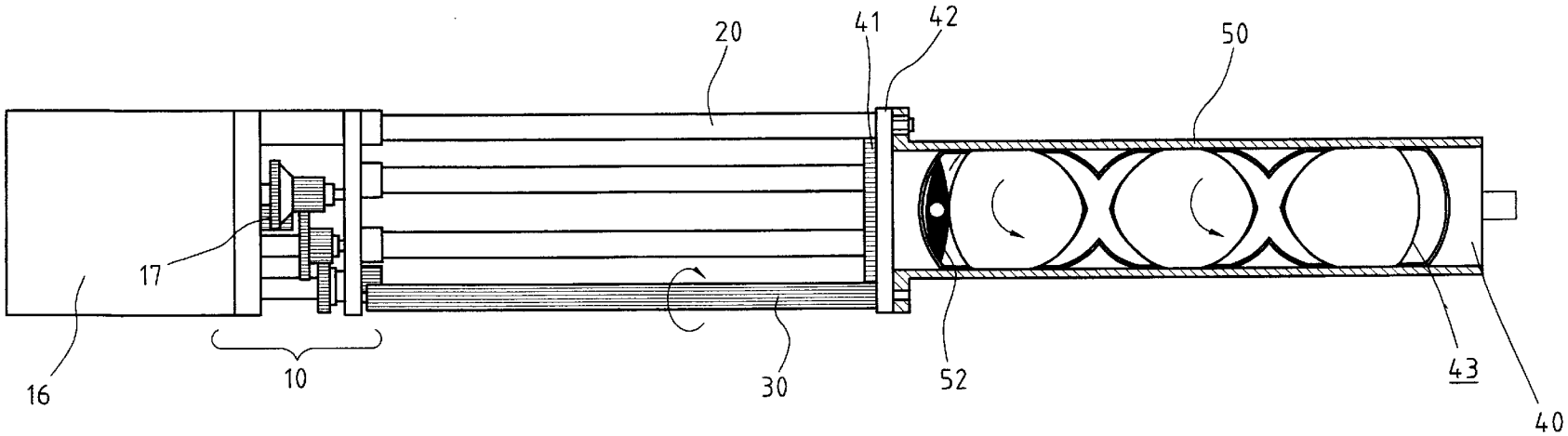
Figure 8:
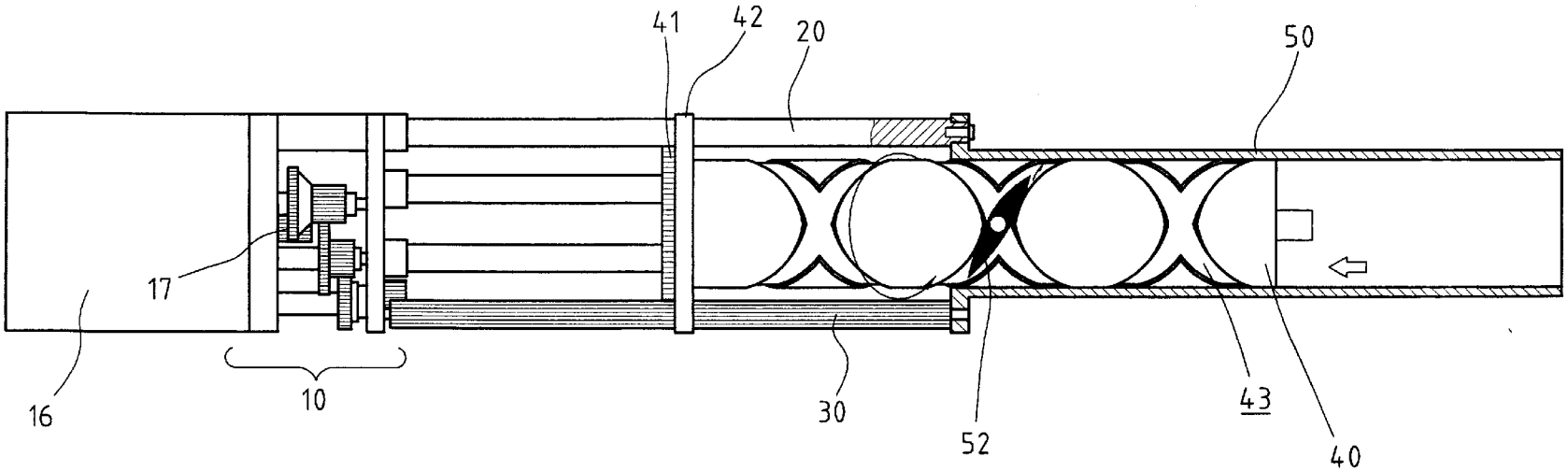
FIG. 8 is an operational view of the rotation shaft, wherein the movement direction of the rotation shaft is opposite to that shown in FIGS. 5, 6 and 7.

With reference to FIGS. 5 to 8, when the motor 16 is activated by the switch 82 on the control box 80, the shaft 17 is driven to rotate, which drives the reduced gear assembly 10, the transmission rod 30 and the annular gear 41 to rotate simultaneously. Because the annular gear 41 is securely mounted on one side of the rotation shaft 40, the rotation shaft 40 is driven to rotate. It is notable that when the rotation shaft 40 rotates, the guide 52 within the arcuate groove 43 has a movement direction opposite to the operational direction of the rotation shaft 40. That is, when the rotation shaft 40 moves to the right (as shown in FIG. 5 indicated by arrow), the guide 52 has an opposite direction relative to the rotation shaft 40. After the rotation shaft 40 reaches the foremost end of the sleeve 50, the continuous rotation of the rotation shaft 40 allows the guide 52 to make a U turn in the annular groove 43, thereafter, the continuous rotation of the rotation shaft 40 makes the rotation shaft 40 to move to the left (as shown in FIG. 8 indicated by the arrow) and return to the original point.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An extendable and rotatable massager comprising a reduced gear assembly, sliding bars, a transmission rod, a rotation shaft, a sleeve, a positioning sleeve and an extension tube, wherein the reduced gear assembly has gears respectively and rotatably mounted between a first disk and a second disk, the first disk has a through hole corresponding to an auxiliary gear on one of the gears, the second disk has a shaft hole corresponding to a shaft of a motor to allow the shaft to mate with one of the gears;

each of the sliding bars extend through the first disk and securely engage with the second disk;

the transmission rod is securely mounted to the first disk at one end so as to mate with one of the gears;

the rotation shaft has an annular gear mounted on one end, a disk rotatably and movably mounted on the rotation shaft and arcuate grooves defined in a periphery of the rotation shaft and maintained a predetermined angle to a longitudinal axis of the rotation shaft to form a closed loop on the periphery of the rotation shaft;

the sleeve has a guide securely yet rotatably received inside the sleeve to corresponding to the arcuate grooves of the rotation shaft;

the positioning sleeve has a skirt with screw holes, such that screws are able to threadingly extend through the screw holes of the positioning sleeve, screw holes of the sleeve and into engaging holes of the sliding bars to secure the positioning sleeve to one distal end of each of the sliding bars; and the extension tube securely connects to the rotation shaft at one end of the extension tube.

2. The massager as claimed in claim 1, wherein the gears comprises a first gear, a second gear and a third gear.

3. The massager as claimed in claim 2, wherein the first disk has an assembly hole defined to allow a connection rod of one of the sliding bars to extend therethrough; and wherein the second disk has assembly tubes, a shaft hole and screw holes so that screws are able to threadingly extend through the screw holes to fix the second disk to the motor.

4. The massager as claimed in claim 1, wherein each of the sliding bars has a connection rod provided on one end to extend through the first disk and securely engage with the second disk.

5. The massager as claimed in claim 1, wherein the transmission rod has a positioning rod on opposite ends and one of the positioning rods extend through the first disk to mate with the auxiliary gear.

6. The massager as claimed in claim 1, wherein the disk of the rotation shaft has through holes corresponding to the sliding bars and the transmission rod to allow the sliding bars and the transmission rod to extend through the disk.

7. The massager as claimed in claim 1, wherein the rotation shaft has a connection rod on one end and provided with a connection hole and the extension tube has a screw hole defined to align with the connection hole.

8. The massager as claimed in claim 1, wherein the sleeve has a flange formed on one end and having screw holes and a positioning hole defined to allow a positioning rod of the transmission rod to extend through the positioning hole so as to position the transmission rod relative to the sleeve.

9. The massager as claimed in claim 1, wherein the guide is arcuate with two opposite sharpened ends, the guide has a shaft hole so that the guide is able to rotatably received in the sleeve by screws after the alignment between the shaft hole and a through hole in a periphery of the sleeve.

10. The massager as claimed in claim 1, wherein the positioning sleeve has a skirt provided with screw holes so that the positioning sleeve is able to engage with the sliding bars by screws extending through the screw hole of the positioning sleeve, the screw holes of the sleeve and engaging holes of the sliding bars.

* * * * *